US006152655A

United States Patent [19]

Hull

[11] Patent Number: 6,152,655

[45] Date of Patent: Nov. 28, 2000

[54] MASONRY BLOCK FOR RETAINING AND FREESTANDING WALLS

[76] Inventor: Kent D Hull, 19226 Bernhill, Colbert, Wash. 99005

[21] Appl. No.: 09/307,419

[22] Filed: May 5, 1999

[51] Int. Cl.[7] ..... E02D 29/02

[52] U.S. Cl. ..... 405/286; 405/284; 52/592.6; 52/606

[58] Field of Search ..... 405/262, 284, 405/285, 286; 52/596, 603, 604, 605, 606, 607, 592.6, 592.1

[56] References Cited

U.S. PATENT DOCUMENTS

| | | | |
|---|---|---|---|
| 250,635 | 12/1881 | McLean | 52/306 |
| D. 280,024 | 8/1985 | Risi et al. | D25/80 |
| D. 301,063 | 5/1989 | Risi et al. | D25/113 |
| 776,441 | 11/1904 | Veyon | 52/606 |
| 3,416,276 | 12/1968 | Caputo | 52/606 |
| 4,815,897 | 3/1989 | Risi et al. | 405/284 |
| 5,017,049 | 5/1991 | Sievert | 405/286 |
| 5,064,313 | 11/1991 | Risi et al. | 405/286 |
| 5,120,164 | 6/1992 | Iacocca et al. | 405/284 |
| 5,224,792 | 7/1993 | Hagenah | 52/603 |
| 5,282,700 | 2/1994 | Rodrique | 405/284 |
| 5,417,523 | 5/1995 | Scales | 405/262 |
| 5,528,873 | 6/1996 | Correia et al. | 405/284 |
| 5,622,456 | 4/1997 | Risi et al. | 405/284 |
| 5,765,970 | 6/1998 | Fox | 405/284 |
| 5,800,097 | 9/1998 | Martin | 405/284 |
| 5,816,749 | 10/1998 | Bailey, III | 405/286 |
| 5,827,015 | 10/1998 | Wodford et al. | 405/286 |

*Primary Examiner*—Eileen D. Lillis
*Assistant Examiner*—Frederick L. Lagman
*Attorney, Agent, or Firm*—David S. Thompson

[57] ABSTRACT

A masonry block includes a top face 20 having a protrusion 23 which is sized to engage the indentation 31 defined in the bottom faced 30 of an adjacent masonry block. The protrusion 23 is flanked by a wide flat surface 21 and a narrow flat surface 22, while the indentation 31 is similarly flanked by a wide flat surface 32 and a narrow flat surface 33. Where the wide flat surface 21 of a lower masonry block is adjacent to the narrow flat surface 33 of an upper masonry block, a retaining wall 100 having an angle of repose results. Where the wide flat surface 21 of the lower masonry block is adjacent to the wide flat surface 32 of the upper masonry block, a freestanding wall 110 that is vertically oriented results.

1 Claim, 5 Drawing Sheets

MASONRY BLOCK FOR RETAINING AND FREESTANDING WALLS

CROSS-REFERENCES

There are no applications related to this application filed in this or any foreign country.

BACKGROUND

A number of masonry blocks for use in making both retaining walls and freestanding walls are known. A preferred version of such blocks must be adapted to stacking in a first manner to result in a wall that is recessed for use in a retaining wall, and also adapted to stacking in a second manner to result in a freestanding vertical wall.

Known masonry blocks have generally suffered from one or more limitations which prevent their widespread adoption. Some masonry blocks have only one finished face, and therefore are adapted for use as a retaining wall, wherein a face opposed to the finished face is embedded into the earth retained behind the wall. Such blocks are therefore not well adapted for use in the construction of freestanding walls, since one side would be unfinished.

Other masonry blocks do not provide the means to interlock adjacent courses or rows of blocks with the course immediately above and below. Without such interlocking structures, a wall cannot be constructed with the desired strength.

Similarly, known blocks have failed to provide a satisfactory structure to allow interlocking of adjacent courses of blocks in a manner that results in a retaining wall that slopes at an angle of repose, and that may alternatively result in a freestanding wall that is vertical.

Known blocks have disclosed several structures to permit connection of a retaining wall to one or more deadmen or anchors buried behind the wall for structural strength. However none of the known structures provide a means to secure a retaining wall with the required strength, low-cost and design flexibility that is desired.

Known blocks have allowed reinforcement of the wall by passing rebar through openings within the blocks. However, known blocks have failed to disclose a cavity suitable for the passage of rebar that is adapted to "post tension" construction of a freestanding wall, which permits construction of a wall with no need of a concrete foundation in cold climates, and that is also adapted to attachment to one or more deadmen or anchors in the construction of a retaining wall.

For the foregoing reasons, there is a need for a masonry block for retaining and freestanding walls that provides two finished faces, is interlockable with both adjacent upper and a lower concourses in a manner that will result in a recessed retaining wall or a vertical freestanding wall, that is adapted for attachment to deadmen in a retaining wall application and that is also adapted to "post tension" construction in a freestanding wall application.

SUMMARY

The present invention is directed to an apparatus that satisfies the above needs. A novel masonry block adapted to construction of both retaining and freestanding walls is disclosed having structures to engage adjacent upper and lower concourses of blocks in a manner that results in either a vertical wall or a retaining wall having an angle of repose, as desired. Among other features, the block should additionally have structures that enable the use of rebar or cable for attachment to deadmen or anchors or to allow "post tension" construction.

The masonry block for retaining and freestanding walls of the present invention provides some or all of the following structures.

(A) A top face defines a lengthwise protrusion which is flanked on a first side by a first wide flat surface and on a second side by a first narrow flat surface. A preferred protrusion is defined by a flat ridge surface flanked by first and second inclined surfaces.

(B) A bottom face defining a lengthwise indentation flanked on a first side by a second narrow flat surface and on a second side by a second wide flat surface. A preferred indentation is defined by adjacent third and fourth inclined surfaces oriented lengthwise, the third inclined surface adjacent to the second narrow flat surface and the fourth inclined surface adjacent to the second wide flat surface.

(C) A first finished face, separated from the top face by a first upper rounded edge and from the bottom face by a first lower rounded edge.

(D) A second finished face, separated from the top face by a second upper rounded edge and from the bottom face by a second lower rounded edge.

(E) Borrowing from terminology used in bar magnets, each masonry block may be viewed to provide a "north" face and a "south" face. The usefulness of such north and south terminology being that a wall built with each block in every layer, row or concourse having the "north" face oriented in the same direction results in a retaining wall having an angle of repose, i.e. a wall that is not vertical, and which is built against a hillside. In contrast, a wall built in which all of the blocks in each concourse have the north face oriented in the same direction, but where the north faces of the blocks in each concourse are directed oppositely to the north faces of the blocks forming concourse immediately below, results in a freestanding vertical wall.

(F) Opposed "north" and "south" faces each comprise a flat end surface. The flat end surfaces may be parallel or oriented at a slightly skewed angle. Where the north and south faces are parallel, a straight wall results. Where the planes defined by the surfaces of the north and south faces are at a slightly skewed angle, the wall will be gently curving.

(G) An axial cavity, defined between openings on the opposed north and south faces.

(H) In one embodiment, a restraint attachment cavity is defined by a recessed surface in the flat end surface of the north or south face. The restraint attachment cavity allows passage of a fastener associated with a restraint system, which allows a retaining wall to be secured to anchors buried within the earth being retained.

It is therefore a primary advantage of the present invention to provide a novel masonry block that is adapted for use in the construction of both retaining and freestanding walls.

Another advantage of the present invention is to provide novel masonry block that is adapted for attachment of fasteners used to restrain a retaining wall in conjunction with a deadman buried behind the retaining wall.

A still further advantage of the present invention is to provide a novel masonry block that is adapted for horizontal passage of rebar through an axial cavity defined in the block, to thereby enhance the strength of a resulting wall, and to allow use of a restraining system in a retaining wall and to allow "post tension" construction of a freestanding vertical wall.

DRAWINGS

These and other features, aspects, and advantages of the present invention will become better understood with regard to the following description, appended claims, and accompanying drawings where:

DESCRIPTION

Figure 1:
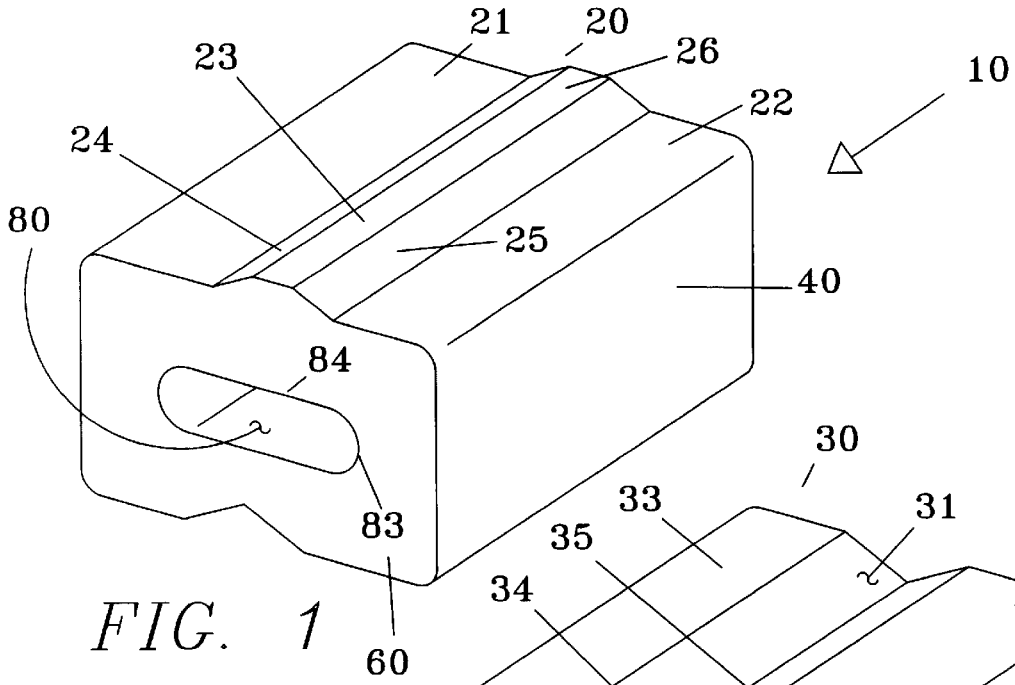
FIG. 1 is perspective view of a version of the masonry block of the invention, having a protrusion defined on the top face.
Figure 2:
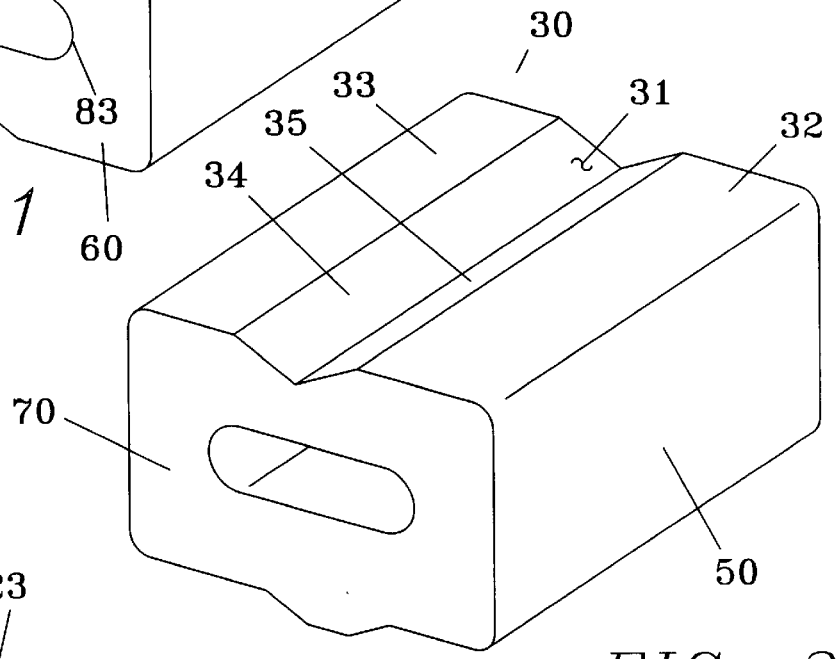
FIG. 2 is a perspective view of the bottom face of the masonry block of FIG. 1.
Figure 3:
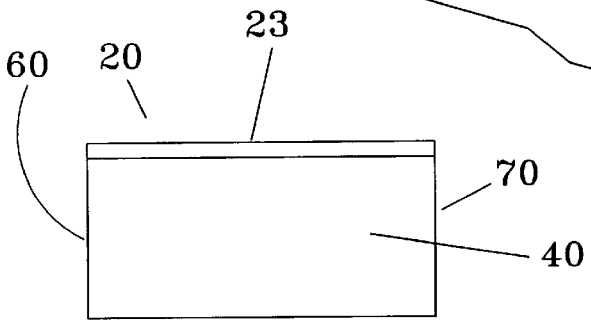
FIG. 3 is a side view of the masonry block of FIG. 1.
Figure 4:
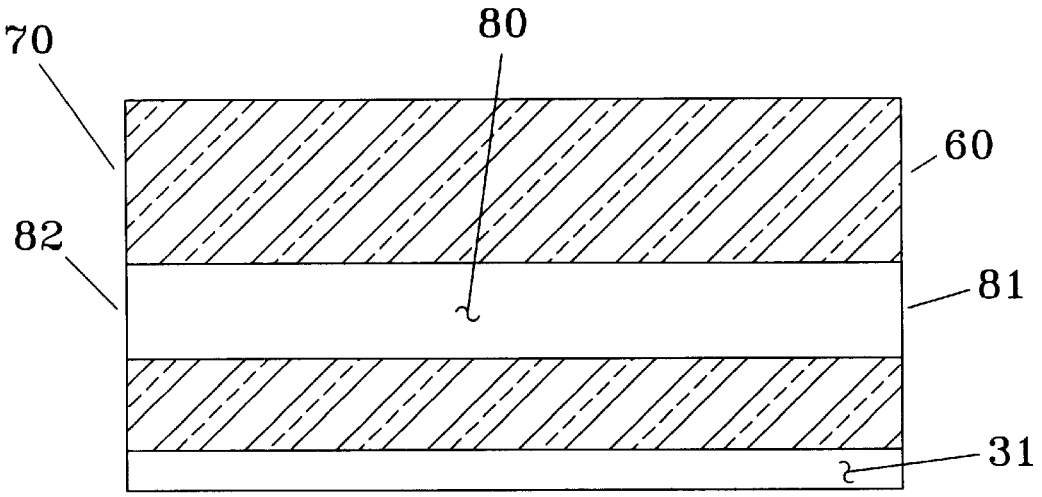
FIG. 4 is a cross-sectional view of the masonry block of FIG. 1.

As is best seen in FIGS. 1 and 2, a masonry block 10 is generally six-sided, and is suitable for stacking to form a retaining wall with an angle of repose, or a freestanding vertical wall. A preferred version of the masonry block has a nominal finished size of 9" wide by 6" tall by 12" long. A preferred masonry block includes a top face 20 having a protrusion 23 which is sized to engage the indentation 31 defined in the bottom faced 30 of an adjacent masonry block. The protrusion 23 is flanked by a wide flat surface 21 and a narrow flat surface 22, while the indentation 31 is similarly flanked by a wide flat surface 32 and a narrow flat surface 33. Where the wide flat surface 21 of a lower masonry block is adjacent to the narrow flat surface 33 of an upper masonry block, a retaining wall 100 having an angle of repose results. Where the wide flat surface 21 of the lower masonry block is adjacent to the wide flat surface 32 of the upper masonry block, a vertically oriented freestanding wall 110 results.

A preferred version of the top face 20 of the masonry block 10 is 8.8750" wide by the 12" length of the block long. The width of the top face is divided into three portions: a first wide flat surface 21, a first narrow flat surface 22 and a protrusion 23. The protrusion 23 is flanked on a first side by a first wide flat surface 21 and on a second side by a first narrow flat surface 22. The first wide flat surface, protrusion and the first narrow flat surface are all oriented in the lengthwise direction, i.e. extending from the north face to the south face.

The lengthwise protrusion 23 is sized to engace the lengthwise indentation 31 defined on the bottom face 30. In a preferred embodiment, the protrusion is 3" wide by the 12" length of the preferred masonry block. A preferred protrusion 23 is formed by a flat ridge surface 26 flanked on a first side by a first inclined surface 24 and on a second side by a second inclined surface 25.

The preferred flat ridge surface 26 is 1" wide by the 12" length of the brick. The flat ridge surface is planar, and is parallel to the first wide flat surface and first narrow flat surface. The distance between the plane of the ridge surface 26 and the wide and narrow flat surfaces 21, 22 is 0.5" in a preferred embodiment.

Figure 5:
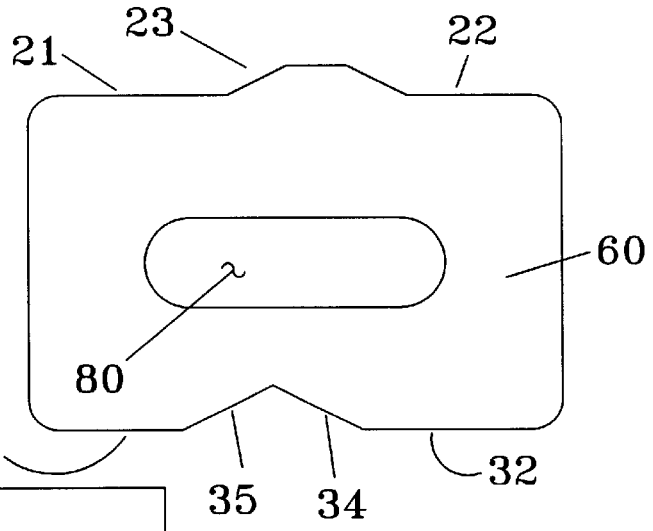
FIG. 5 is an end view of the masonry block of FIG. 1.
Figure 6:
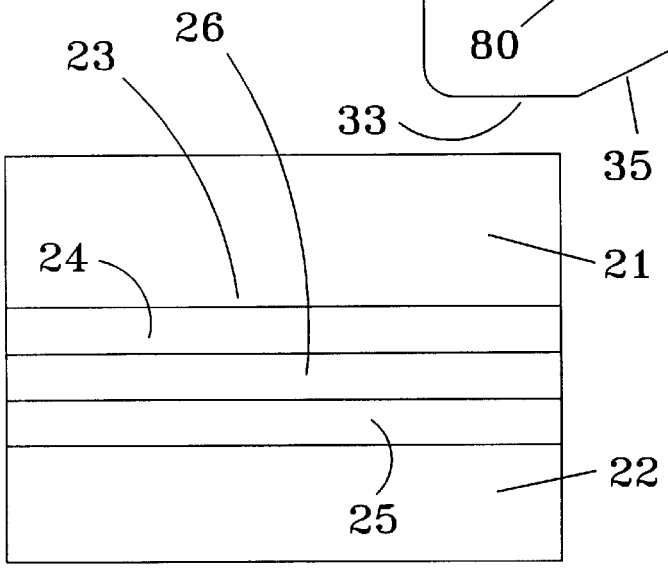
FIG. 6 is a top view of the masonry block of FIG. 1.

A first edge of the first inclined surface 24 is adjacent to the edge of the first wide flat surface 21, while a second edge of the first inclined surface is adjacent to a first edge of the flat ridge surface. Referring to FIG. 5, a preferred angle between the first inclined surface and the first wide flat surface is 153 degrees.

Similarly, a first edge of the second inclined surface 25 is adjacent to the edge of the first narrow flat surface 22, while a second edge of the second inclined surface is adjacent to a second edge of the flat ridge surface. A preferred angle between the first inclined surface and the first wide flat surface is 153 degrees.

The angle between the inclined surfaces 24, 25 and flat surfaces 21, 22, 26 is somewhat flexible, but should be selected to result in sufficient surface area contact between the top face of a first masonry block and the bottom face of a second masonry block. Greater surface area of contact results in greater friction and a better connection between adjacent masonry blocks. Where the angle is less, the protrusion tends to extend further, thereby resulting in greater surface area of contact, but also resulting in protrusion that is more easily broken off and which may require more space in the mold during manufacture. The angle should be selected by balancing these issues with the selection of the material type to be used in the masonry block's manufacture.

Figure 9:
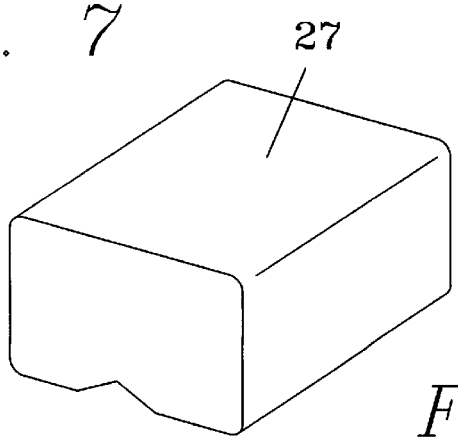
FIG. 9 is a perspective view of a version of the masonry block having no protrusion on the top face.
Figure 10:
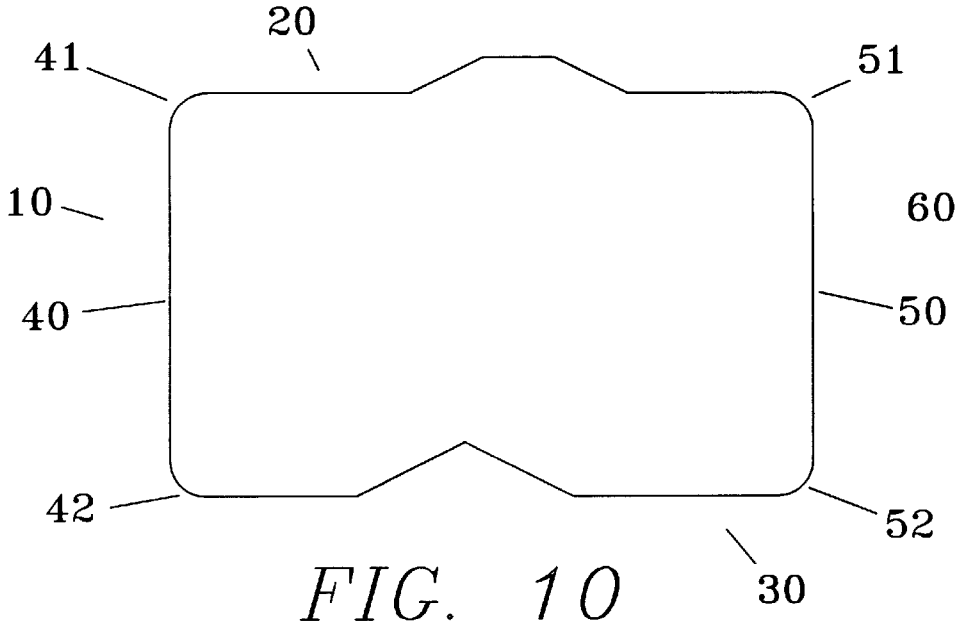
FIG. 10 is an end view of a version of the masonry block having no axial cavity within the block.

In a preferred embodiment, the first wide flat surface 21 is 3.3125" wide by the 12" length of the masonry block. The first narrow flat surface 22 is 2.5625" wide by the 12" length of the masonry block. The exact dimensions of these surfaces could be altered somewhat, as desired, to better control the angle of repose of a retaining wall 100 constructed with the masonry blocks.

Where the masonry block is intended for use on the top row or concourse of the wall, it may be desirable to have a top face that does not provide a protrusion. As seen in FIG. 9, a version of the masonry block of the invention does not provide a protrusion, and therefore provides a flat top surface 27 having approximate dimensions of 8.8750" by the 12" length of the masonry block.

A preferred version of the bottom face 30 of the masonry block 10 is 8.8750" wide by the 12" width of the block long. The width of the bottom face is divided into three portions: a second wide flat surface 32, a second narrow flat surface 33 and a lengthwise indentation 31. The indentation is flanked on a first side by a second narrow flat surface 33 and on a second side by a second wide flat surface 32. The second wide flat surface, the indentation and the second narrow flat surface are all oriented in the lengthviise direction.

The lengthwise indentation 31 is sized to engage the lengthwise protrusion 23 defined on the top surface 20. In a preferred embodiment, the indentation is 3" wide by the 12" length of the preferred masonry block. A preferred indentation 31 is formed from adjacent third and fourth inclined surfaces 34, 35.

The third and fourth inclined surfaces oriented are lengthwise. A first edge of the third inclined surface 34 is adjacent to the edge of the second wide flat surface 32, while a second edge of the first inclined surface is adjacent to a first edge of the fourth inclined surface 35. Similarly, the second edge of the fourth inclined surface is adjacent to the edge of the second narrow flat surface 33.

A preferred angle between the first inclined surface and the first wide flat surface is 153 degrees.

Where the top face of a first masonry block is adjacent to the bottom face of a second masonry block, a channel 35 is defined between the flat ridge surface 26 of the protrusion 23 and the indentation 31. Alternatively, the indentation 31 may be made to fit exactly the protrusion 23, described above.

In a preferred embodiment, the second wide flat surface 21 is 3.3125" wide by the 12" length of the masonry block. The second narrow flat surface 22 is 2.5625" wide by the 12" length of the masonry block. The exact dimensions of these surfaces could be altered somewhat, as desired, to better control the angle of repose of a retaining wall 100 constructed with the masonry blocks. However, these dimensions should closely match the associated dimensions of the first wide flat surface and the first narrow flat surface.

In a preferred embodiment, both of the first and second exposed faces 40, 50 are finished in a manner that may be adjusted according to the style or design desired. Unlike the top face, bottom face, north face or south face, the exposed faces are not adjacent to the faces of other masonry blocks, and are therefore considered exposed. In a retaining wall application, only one of the exposed faces would be visible, since the other exposed face would be directed to the earth to be retained. However, in a freestanding wall application, both exposed sides would be visible.

The first exposed face 40 is separated from the top face 20 by a first upper rounded edge 41 and from the bottom face by a first lower rounded edge 42. Similarly, the second finished face 50 is separated from the top face by a second upper rounded edge 51 and from the bottom face by a second lower rounded edge 52. In a preferred embodiment, each of the rounded edges has a 0.5" radius, although the exact radius desired may depend in part on the style of the masonry block and the material used in its manufacture.

A north face 60 is adjacent to the top face 20, the bottom face 30 and to both exposed faces 40, 50.

Similarly, a south face 70 is adjacent to the top face 20, the bottom face 30 and to both exposed faces 40, 50.

The terminology behind designating one face as the "north" face and one face as the "south" face allows better understanding of the use of the masonry block. For example, in each layer or concourse in a wall, the north face of all the masonry blocks point in one direction. As a result, the protrusions 23 are all similarly oriented.

Figure 11:
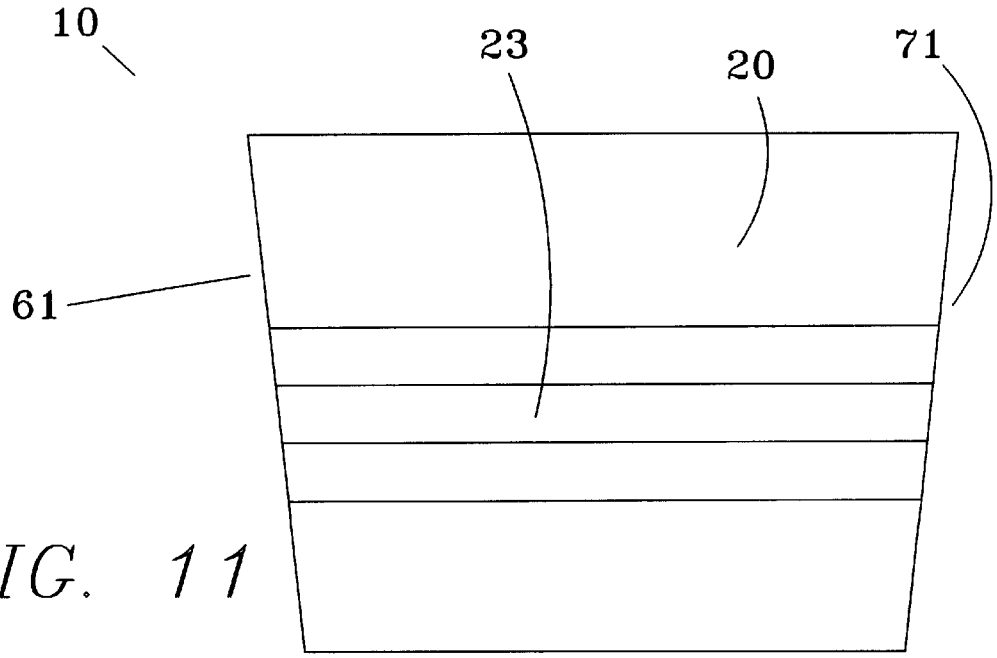
FIG. 11 is a top view of a version of the masonry block having north and south ends that are not in parallel planes, and that is adapted for use in making a curving wall.

In some retaining wall or freestanding wall applications, it is desired to construct a wall in a configuration that is curving when viewed from above. To construct such a wall, a version of the north face seen in FIG. 11 provides an angled end surface 61, 61 that results in a curved wall. A preferred angled end surface is angled at 6 degrees; however alternate angles could be used to result in any desired wall curvature.

An axial cavity 80 extends from an opening in the north face 81 to an opening in the south face 82. Due to the orientation of the axial cavity, rebar, cable or other reinforcing material may be passed in a horizontal direction through the collinear axial cavities of a number of masonry blocks forming a row or concourse.

Such reinforcing material is advantageous in the construction of freestanding vertical walls because tension may be applied to the cable or rebar by attaching the ends of the cable or rebar to posts at regular intervals. This tends to support the wall, and may eliminate the need for a concrete foundation for the wall, even in climates where the ground will freeze.

Alternatively, where a retaining wall is used, passage of rebar through the collinear axial cavities of masonry blocks of a concourse allows the attachment of restraint elements which may be passed through the restraint attachment cavity 90 for attachment to the rebar. The restraint elements may then be attached to deadmen or anchors buried within the earth being retained by the retaining wall.

In a preferred axial cavity, the openings 81, 82 are defined by a half round edge 83 and a linear edge 84. A preferred half round edge has a radius of 0.75", but may alternatively be larger or smaller, as desired. The preferred width of the axial cavity, measured from the middle of opposed half round edges is 5"; however this dimension is also somewhat variable, as desired.

Figure 12:
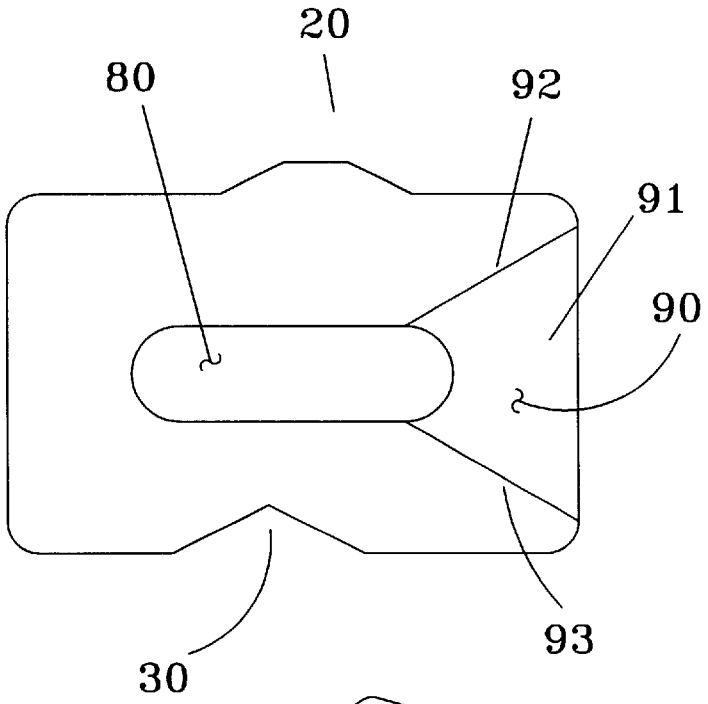
FIG. 12 is an end view of a version of the masonry block having a restraint attachment cavity defined in the flat end surface of one end of the block.
Figure 13:
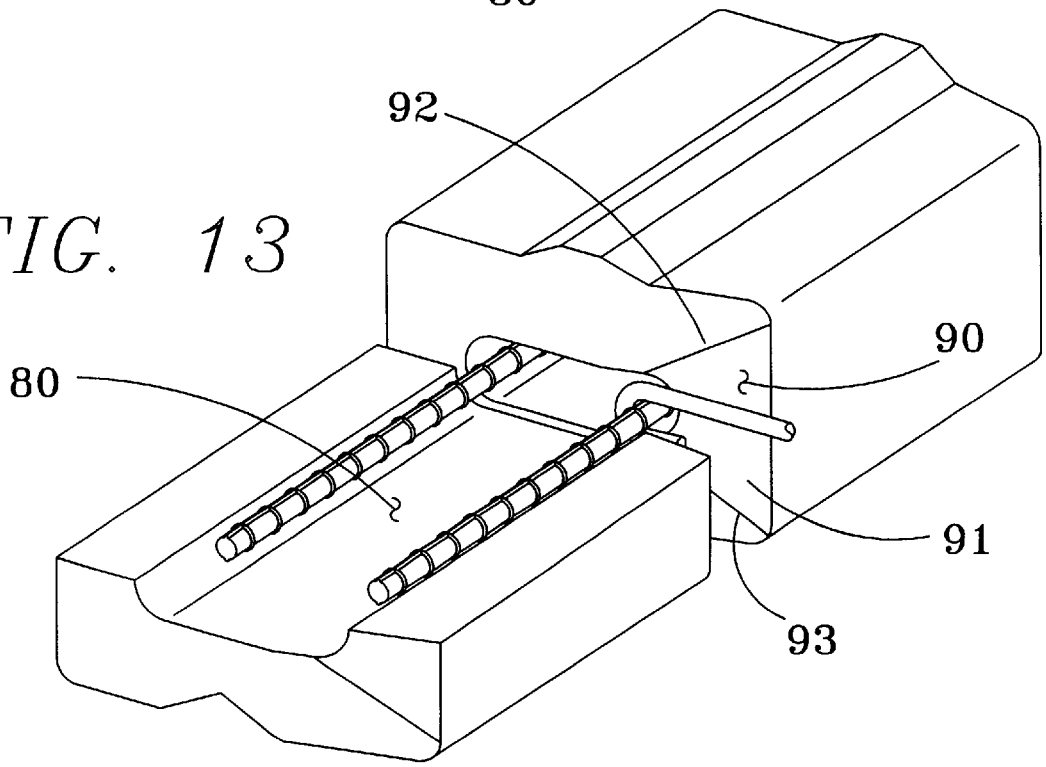
FIG. 13 is a perspective view having a partial cut-away of a masonry block having a restraint attachment cavity having a hook passing through that cavity and about a piece of rebar carried within the axial cavity.

As seen in FIGS. 12 and 13, a restraint attachment cavity 90 may optionally be defined in either the north face or south face. The restraint attachment cavity 90 allows attachment of a restraint to rebar passing through the axial cavity. A typical restraint may comprise a cable having a first end having a hook or similar fastener and a second end terminating in a deadman or similar device for anchoring a retaining wall. The hook would be sized for passage through the restraint attachment cavity.

In a preferred embodiment of the invention, the restraint attachment cavity 90 is defined within a region enclosed by a recessed surface 91 defined in either the north or south face of a masonry block and the flat end surface 60, 70 of an adjacent masonry block. Such a restraint attachment cavity allows passage of a hook or fastener from a restraint such as a cable. The hook is able to access and attach to rebar or cable within the axial cavity 80. The cable attached to the hook is then attached to a deadman or similar anchoring device buried within the earth behind the retaining wall. This tends to prevent movement of a retaining wall.

Continuing to refer to FIG. 12, the restraint attachment cavity is defined by a recessed surface 91 that is generally parallel to the flat end surface 60 or 70 of the north or south face within which the recessed surface is defined. In a preferred version of the invention, the recessed surface 91 is recessed 0.1875" from the flat end surfaces 60 or 70. The restraint attachment cavity is bounded by the half round edge 83 of the axial cavity 80, and upper and lower angled edges 92, 93 extending from the axial cavity to the second finished surface.

Figure 7:
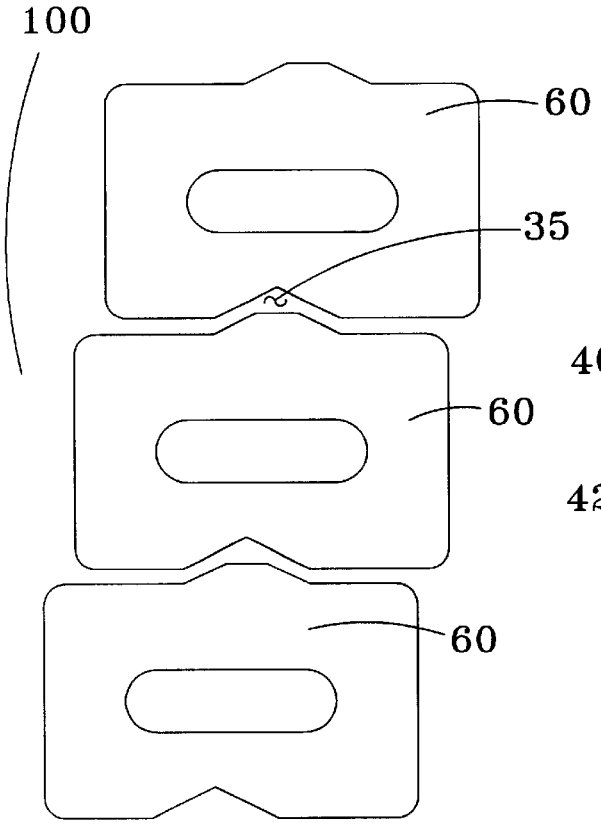
FIG. 7 is a side view of a retaining wall built with a number of masonry blocks.
Figure 8:
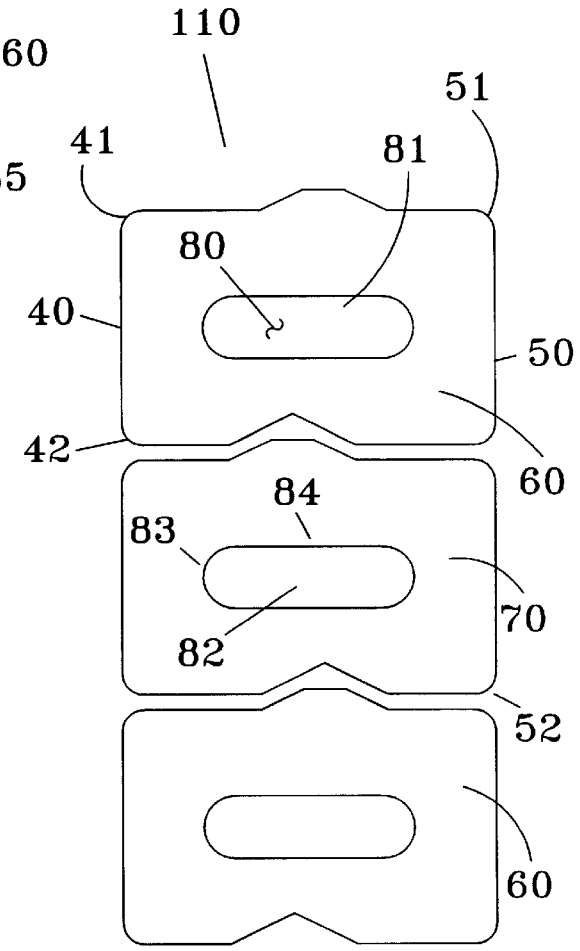
FIG. 8 is a side view of a freestanding wall built with a number of masonry blocks.

To construct a retaining wall having an angle of repose, a first layer, row or concourse of masonry blocks is laid with the north ends all facing a first direction and the south ends facing an opposite direction. A second layer, now or concourse is then placed on top of the first row. The protrusion 23 of each block in the upper layer is inserted into the indentation 31 of the lower layer. The north ends of each block in the second layer is pointed in the same direction that the north ends of the blocks in the first layer are pointing. As seen in FIG. 7, the second layer is recessed somewhat from the first layer, so that the face of the wall will slope somewhat.

Where desired, rebar, cable or other reinforcing material may be inserted into the axial cavity 80 of adjacent blocks.

Where the appropriate, a masonry block, as seen in FIG. 12, having a recessed surface 91 defined in the flat end surface of the north or south face may be used. The resulting restraint attachment cavity 90 defined between the recessed surface 91 and an adjacent masonry block allows the attachment to rebar carried within the axial cavity 80 of a fastener associated with a deadman or similar anchor buried within the earth retained by the wall.

To construct a vertical freestanding wall, the direction of every other row or concourse of masonry blocks is reversed. For example, where in the lowest row of blocks the north face is pointed in a first direction, in a second row or layer laid immediately above the first layer the north face is pointed in the opposite direction. This results in contact between the first and second wide flat surfaces 21, 32 and between the first and second narrow flat surfaces 22, 33. As a result, the resulting wall is vertical.

Where a curved wall is desired, blocks constructed according to the version of the invention seen in FIG. 11, having angled end surfaces 61, 71, are used. Use of masonry blocks having angled end surfaces is adaptable to the construction of either freestanding vertical walls or retaining walls.

The previously described versions of the present invention have many advantages, including a primary advantage of providing a novel masonry block that is adapted for use in the construction of both retaining and freestanding walls.

Another advantage of the present invention is to provide novel masonry block that is adapted for attachment of fasteners used to restrain a retaining wall in conjunction with a deadman buried behind the retaining wall.

A still further advantage of the present invention is to provide a novel masonry block that is adapted for horizontal passage of rebar through an axial cavity defined in the block, to thereby enhance the strength of a resulting wall, and to allow use of a restraining system in a retaining wall and to allow "post tension" construction of a freestanding vertical wall.

Although the present invention has been described in considerable detail and with reference to certain preferred versions, other versions are possible. For example, while a number of exact dimensions have been disclosed, it is clear that some alteration of the dimensions could be undertaken while still following the teachings of the invention. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A masonry block comprising:

(A) a top face defining a lengthwise protrusion, the protrusion flanked on a first side by a first wide flat surface and on a second side by a first narrow flat surface, the protrusion defined by a flat ridge surface flanked by first and second inclined surfaces;

(B) a bottom face defining a lengthwise indentation flanked on a first side by a second narrow flat surface and on a second side by a second wide flat surface, the indentation defined by adjacent third and fourth inclined surfaces oriented lengthwise, the third inclined surface adjacent to the second narrow flat surface and the fourth inclined surface adjacent to the second wide flat surface;

(C) a first finished face, separated from the top face by a first upper rounded edge and from the bottom face by a first lower rounded edge;

(D) a second finished face, separated from the top face by a second upper rounded edge and from the bottom face by a second lower rounded edge;

(E) a north face, adjacent to the top face and to the bottom face;

(F) a south face, adjacent to the top face and to the bottom face;

(G) an axial cavity extending from an opening in the north face to an opening in the south face;

(H) a restraint attachment cavity defined in the north face, the cavity adjacent to a recessed surface generally parallel to the north face, a half round edge in the opening of the north face and a first upper and a first lower angled edge extending from the axial cavity to the second finished face; and (I) whereby a wall built with each block in every layer, row or concourse having the north face oriented in the same direction results in a retaining wall having an angle of repose and a wall built in which all of the blocks in each concourse have the north face oriented in the same direction, but where the north faces of the blocks in each concourse are directed oppositely to the north faces of the blocks forming concourse immediately below, results in a freestanding vertical wall.

* * * * *